US011458534B2

(12) United States Patent
Arai et al.

(10) Patent No.: US 11,458,534 B2
(45) Date of Patent: Oct. 4, 2022

(54) CAST STRIP MANUFACTURING METHOD

(71) Applicant: NIPPON STEEL CORPORATION, Tokyo (JP)

(72) Inventors: Takashi Arai, Tokyo (JP); Masafumi Miyazaki, Tokyo (JP); Naotsugu Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/274,469

(22) PCT Filed: Oct. 17, 2018

(86) PCT No.: PCT/JP2018/038696
§ 371 (c)(1),
(2) Date: Mar. 9, 2021

(87) PCT Pub. No.: WO2020/079783
PCT Pub. Date: Apr. 23, 2020

(65) Prior Publication Data

US 2022/0048102 A1 Feb. 17, 2022

(51) Int. Cl.
*B22D 11/06* (2006.01)
*B22D 11/22* (2006.01)

(52) U.S. Cl.
CPC ..... *B22D 11/0682* (2013.01); *B22D 11/0622* (2013.01); *B22D 11/22* (2013.01)

(58) Field of Classification Search
CPC . B22D 11/06; B22D 11/0622; B22D 11/0682; B22D 11/22
USPC ..... 164/480, 428
See application file for complete search history.

(56) References Cited

U.S. PATENT DOCUMENTS 6,079,480 A 6/2000 Oka et al.

FOREIGN PATENT DOCUMENTS

| | | | |
|---|---|---|---|
| EP | 1 025 931 | A2 | 8/2000 |
| JP | H01-166863 | A | 6/1989 |
| JP | H05-228586 | A | 9/1993 |
| JP | 2957040 | B | 10/1999 |
| JP | 2000-225444 | A | 8/2000 |
| WO | 97/09138 | A1 | 3/1997 |

*Primary Examiner* — Kevin P Kerns
(74) *Attorney, Agent, or Firm* — Myers Wolin, LLC

(57) ABSTRACT

In this cast strip manufacturing method, in a first step, one end side and another end side in a rotation axis direction of a pair of cooling drums are pressed with a first pressure in a direction in which the cooling drums come close to each other, in a second step, the one end side and the another end side in the rotation axis direction of the cooling drums are pressed with a second pressure, which is higher than the first pressure, in the direction in which the cooling drums come close to each other, and in a third step, pressure control is performed so that a total value of reaction forces on the one end side and the another end side in the rotation axis direction of the cooling drums is set to a predetermined value, and rotation axes of the cooling drums are held in parallel.

2 Claims, 7 Drawing Sheets

CAST STRIP MANUFACTURING METHOD

CROSS-REFERENCE TO RELATED APPLICATION

This application is a National Phase of PCT/JP2018/038696, filed on Oct. 17, 2018, and which designated the U.S. The contents of which are wholly incorporated herein by reference.

TECHNICAL FIELD

The present disclosure relates to a cast strip manufacturing method in which molten metal is supplied to a molten metal reservoir formed by a pair of cooling drums and a pair of side weirs to manufacture a cast strip.

RELATED ART

As a manufacturing method for a thin metal cast strip (hereinafter, may be referred to as a cast strip), for example, as shown in Patent Documents 1 and 2, there is provided a manufacturing method using a twin-drum type continuous casting apparatus including a cooling drum having a water-cooled structure inside. In such a manufacturing method, molten metal is supplied to a molten metal reservoir formed between a pair of cooling drums that rotate, and solidified shells formed and grown on peripheral surfaces of the pair of cooling drums are joined to each other at a drum kiss point and reduced to manufacture a cast strip having a predetermined thickness. Such a manufacturing method using the twin-drum type continuous casting apparatus is applied to various types of metal.

Here, in the above-described twin-drum type continuous casting apparatus, in order to manufacture a cast strip having a uniform thickness in a plate width direction, pressure control is performed so that rotation axes of the pair of cooling drums are held in parallel.

Thus, in Patent Document 1, a method is proposed in which pressing forces at both ends of one cooling drum are detected and added, and on the basis of a signal based on this processing, both ends of the other cooling drum are moved in parallel by hydraulic cylinders so that a sum of the pressing forces at both the ends of the one cooling drum is set to a predetermined value.

When casting is started in the above-described twin-drum type continuous casting apparatus, a dummy sheet is sandwiched between the cooling drums, and the molten metal is supplied to the molten metal reservoir formed by the pair of cooling drums and a pair of side weirs. When a certain amount of the molten metal is accumulated in the molten metal reservoir, the cooling drums are rotated to form a cast strip so that the cast strip is connected to the dummy sheet, and the dummy sheet and the cast strip connected to the dummy sheet are pulled out from between the cooling drums.

Therefore, in an unsteady state immediately after the start of casting, deviation in the thickness of the solidified shells is large, and when the pressure control is performed as in Patent Document 1, the solidified shells cannot be sufficiently reduced at the drum kiss point in some cases. In this case, an unsolidified portion is formed in a central portion of the thickness of the cast strip, the surface temperature of the cast strip is relatively high, and the strength is insufficient, which causes breakage or the like of the cast strip, and the casting cannot be started stably. In particular, a hump-shaped locally thickened portion (hereinafter, may be referred to as a thickened portion) is formed on the cast strip immediately after the start of casting because the solidified shells grow with the cooling drums stopped, and the casting is unstable when this thickened portion passes through the drum kiss point.

Therefore, Patent Document 2 proposes a method of switching, between immediately after the start of casting and in a steady state, the pressure control between the pair of cooling drums.

Specifically, in a first step until the thickened portion of the cast strip passes through a closest point (drum kiss point) of the cooling drums after the cooling drums are rotationally started, the pair of cooling drums are pressed with a relatively low pressure in a direction in which the pair of cooling drums come close to each other without parallel control of the cooling drums. Then, in a second step from after the first step until influence of shell washing with a discharge flow of molten steel from a nozzle disappears, the cooling drums are pressed with a higher pressure than in the first step without the parallel control. Furthermore, in a third step after the second step, the parallel control is performed so that the rotation axes of the pair of cooling drums are parallel to each other.

In this Patent Document 2, since the pair of cooling drums are simply pressed in the unsteady state immediately after the start of casting, in which the deviation in the thickness of the solidified shells is large, the solidified shells can be sufficiently reduced at the drum kiss point, and the formation of the unsolidified portion in the central portion of the thickness of the cast strip can be suppressed. Note that the second step until the influence of the shell washing with the discharge flow of the molten steel from the nozzle disappears is a period until a surface of the molten metal rises sufficiently, and the cooling drums rotate about 0.4 rotations in this period.

CITATION LIST

Patent Document

[Patent Document 1]

Japanese Unexamined Patent Application, First Publication No. H01-166863

[Patent Document 2]

Japanese Patent Publication No. 2957040

SUMMARY

Problems to be Solved

However, even when the pressure control of the pair of cooling drums is performed by the method described in Patent Document 2, there is a case where base metal formed on a surface of a side weir is caught between the cooling drums at the start of casting, the solidified shells cannot be sufficiently reduced at the drum kiss point, and the cast strip is broken.

The present disclosure has been made in view of the above-described situation, and an object thereof is to provide a cast strip manufacturing method capable of suppressing breakage of a cast strip and starting casting stably in a twin-drum type continuous casting apparatus.

Means for Solving the Problem

The gist of the present disclosure is as follows.

(1) A first aspect of the present disclosure is a cast strip manufacturing method that supplies molten metal to a molten metal reservoir formed by a pair of cooling drums that rotate and a pair of side weirs, and forms and grows solidified shells on peripheral surfaces of the pair of cooling drums to manufacture a cast strip, the cast strip manufacturing method including pressing one end side and another end side in a rotation axis direction of the pair of cooling drums with a first pressure, which presses the one end side and the another end side with the same pressure, in a direction in which the pair of cooling drums come close to each other, in a first step until a thickened portion of the cast strip passes through a closest point of the pair of cooling drums after starting rotation of the cooling drums, the thickened portion being formed when the molten metal is supplied to the molten metal reservoir with the pair of cooling drums stopped at a start of casting, pressing the one end side and the another end side in the rotation axis direction of the pair of cooling drums with a second pressure, which presses the one end side and the another end side with the same pressure and is higher than the first pressure, in the direction in which the pair of cooling drums come close to each other, in a second step from after the first step until the pair of cooling drums make one or more rotations, and performing pressure control so that a total value of reaction forces on the one end side and the another end side in the rotation axis direction of the pair of cooling drums is set to a predetermined value, and rotation axes of the pair of cooling drums are held in parallel, in a third step after the second step.

(2) In the cast strip manufacturing method described in (1), the second step may be a period from after the first step until the pair of cooling drums make two or more rotations.

Effects

According to the cast strip manufacturing methods described in (1) and (2), parallel control is not performed during a period when a thermal expansion portion of a cooling drum, which is formed at the start of casting, is in contact with a side weir, and the one end side and the another end side in the rotation axis direction of the pair of cooling drums are pressed with the same pressure. Therefore, even if the base metal is caught between the cooling drums, the solidified shells can be sufficiently reduced at a drum kiss point, and formation of an unsolidified portion in a central portion of the thickness of the cast strip is suppressed. As a result, breakage of the cast strip is suppressed, and the casting can be started stably.

Furthermore, in the first step, since the one end side and the another end side in the rotation axis direction of the pair of cooling drums are pressed with the first pressure, which presses the one end side and the another end side with the same pressure, in the direction in which the pair of cooling drums come close to each other, the thickened portion can be passed between the cooling drums relatively stably.

Furthermore, in the second step, since the cooling drums are pressed with the second pressure higher than the first pressure, the solidified shells can be sufficiently reduced at the drum kiss point, and the formation of the unsolidified portion in the central portion of the thickness of the cast strip can be suppressed.

In particular, according to the cast strip manufacturing method described in (2), the period until the cooling drums make two or more rotations is set as the second step, so that the one end side and the another end side in the rotation axis direction of the pair of cooling drums are pressed with the same pressure even if the above-described thermal expansion portion remains until the second rotation. Therefore, the solidified shells can be sufficiently reduced at the drum kiss point, and the formation of the unsolidified portion in the central portion of the thickness of the cast strip can be suppressed. As a result, the breakage of the cast strip can be suppressed, and the casting can be started stably.

As described above, according to the present disclosure it is possible to provide a cast strip manufacturing method capable of suppressing breakage of a cast strip and starting casting stably in a twin-drum type continuous casting apparatus.

DETAILED DESCRIPTION

As a result of diligent studies by the present inventors in order to solve the above problem, the following findings have been obtained.

In a twin-drum type continuous casting apparatus, as described above, since molten metal is supplied to a molten metal reservoir with cooling drums stopped, a contact time between the molten metal and the cooling drums is long at a closest point (drum kiss point) of the cooling drums, and the cooling drums are locally heated and thermally expanded to form a thermal expansion portion. On the other hand, a front side in a drum rotation direction with respect to the drum kiss point is not in contact with the molten metal, and thus is not thermally expanded, and a large step is generated between the front side and the thermal expansion portion.

When the cooling drums rotate and the above-described thermal expansion portion is located in a position where the thermal expansion portion is in contact with a side weir, a gap is formed between the side weir and a cooling drum. The molten metal enters this gap, the molten metal having entered the gap is solidified and integrated with base metal on a surface of the side weir, and this portion is caught between the cooling drums. At this time, if parallel control is performed on the cooling drums, there may be a region where the solidified shells cannot be sufficiently reduced at the drum kiss point, and an unsolidified portion may be formed in a central portion of the thickness of a cast strip, which may cause the cast strip to be broken.

Note that, with passage of time, the local thermal expansion is suppressed, and influence of the above-described thermal expansion portion disappears.

Hereinafter, a cast strip manufacturing method according to an embodiment of the present disclosure made on the basis of the above findings will be described with reference to the attached drawings. Note that the present disclosure is not limited to the embodiment below.

Here, in the present embodiment, molten steel is used as the molten metal, and a cast strip 1 made of steel is manufactured. Furthermore, in the present embodiment, the width of the manufactured cast strip 1 is within the range of 200 mm or more and 1800 mm or less, and the thickness of the manufactured cast strip 1 is within the range of 0.8 mm or more and 5 mm or less.

First, a twin-drum type continuous casting apparatus 10 used in the cast strip manufacturing method according to the present embodiment will be described.

Figure 1:
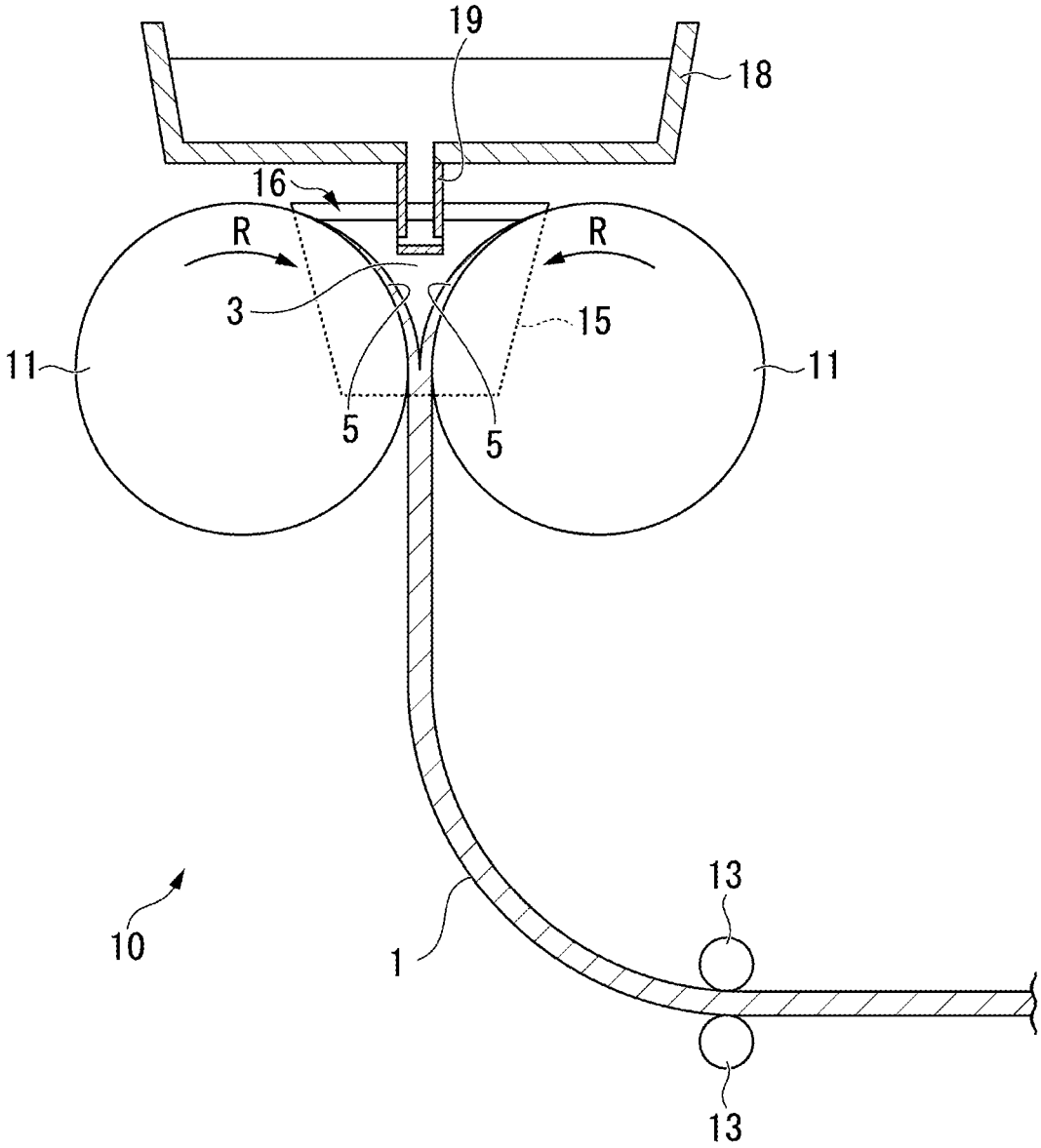
FIG. 1 is an explanatory view illustrating an example of a twin-drum type continuous casting apparatus used in a cast strip manufacturing method according to an embodiment of the present disclosure.

The twin-drum type continuous casting apparatus 10 illustrated in FIG. 1 includes a pair of cooling drums 11 and 11, pinch rolls 13 and 13 that support the cast strip 1, a pair of side weirs 15 and 15 that are arranged at both ends of the pair of cooling drums 11 and 11 in a width direction, a tundish 18 that holds molten steel 3 to be supplied to a molten steel pool portion 16 defined by the pair of cooling drums 11 and 11 and the pair of side weirs 15 and 15, and an immersion nozzle 19 that supplies the molten steel 3 from the tundish 18 to the molten steel pool portion 16.

In this twin-drum type continuous casting apparatus 10, solidified shells 5 and 5 grow on peripheral surfaces of the cooling drums 11 and 11 when the molten steel 3 comes into contact with the rotating cooling drums 11 and 11 to be cooled. The solidified shells 5 and 5 formed on the pair of cooling drums 11 and 11 are then pressure-bonded to each other at the drum kiss point, and thus the cast strip 1 having a predetermined thickness is cast.

Figure 2:
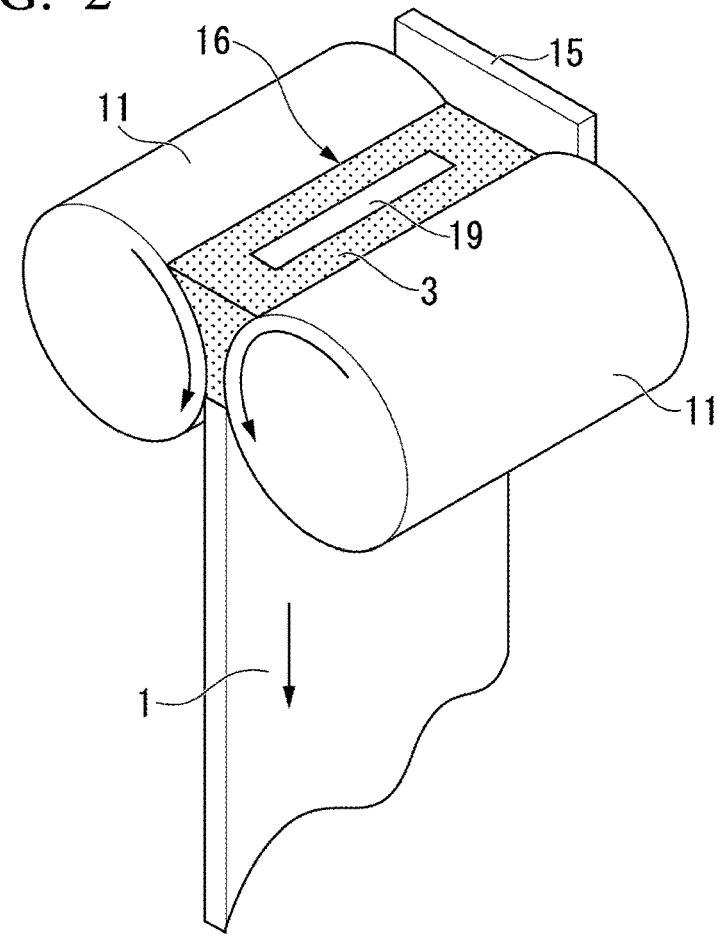
FIG. 2 is a partially enlarged explanatory view of the twin-drum type continuous casting apparatus illustrated in FIG. 1.

Here, as illustrated in FIG. 2, the molten steel pool portion 16 is defined by a side weir 15 being arranged on an end surface of a cooling drum 11.

As illustrated in FIG. 2, a molten steel surface of the molten steel pool portion 16 has a rectangular shape surrounded on all sides by the peripheral surfaces of the pair of cooling drums 11 and 11 and the pair of side weirs 15 and 15, and the immersion nozzle 19 is arranged at the center of the rectangular molten steel surface.

Figure 3:
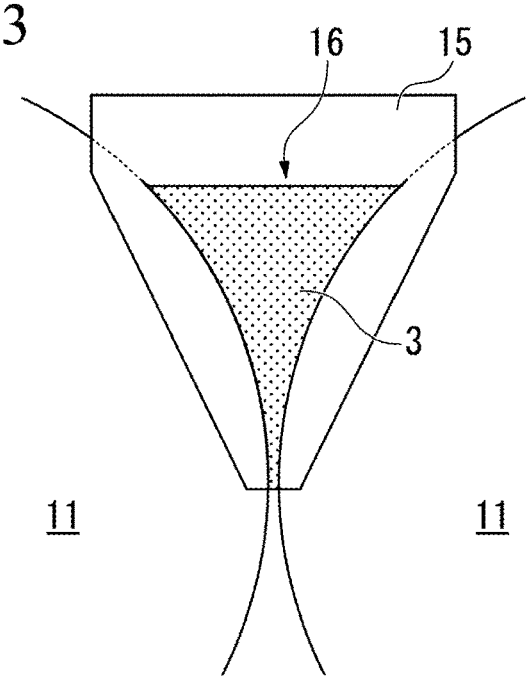
FIG. 3 is an enlarged explanatory view of a side weir of the twin-drum type continuous casting apparatus illustrated in FIG. 1.

Furthermore, as illustrated in FIG. 3, a contact portion of the side weir 15 with the molten steel 3 has a substantially inverted triangular shape. At a start of casting, since the temperature of the side weir 15 is relatively low, base metal M is generated at this contact portion.

Figure 4:
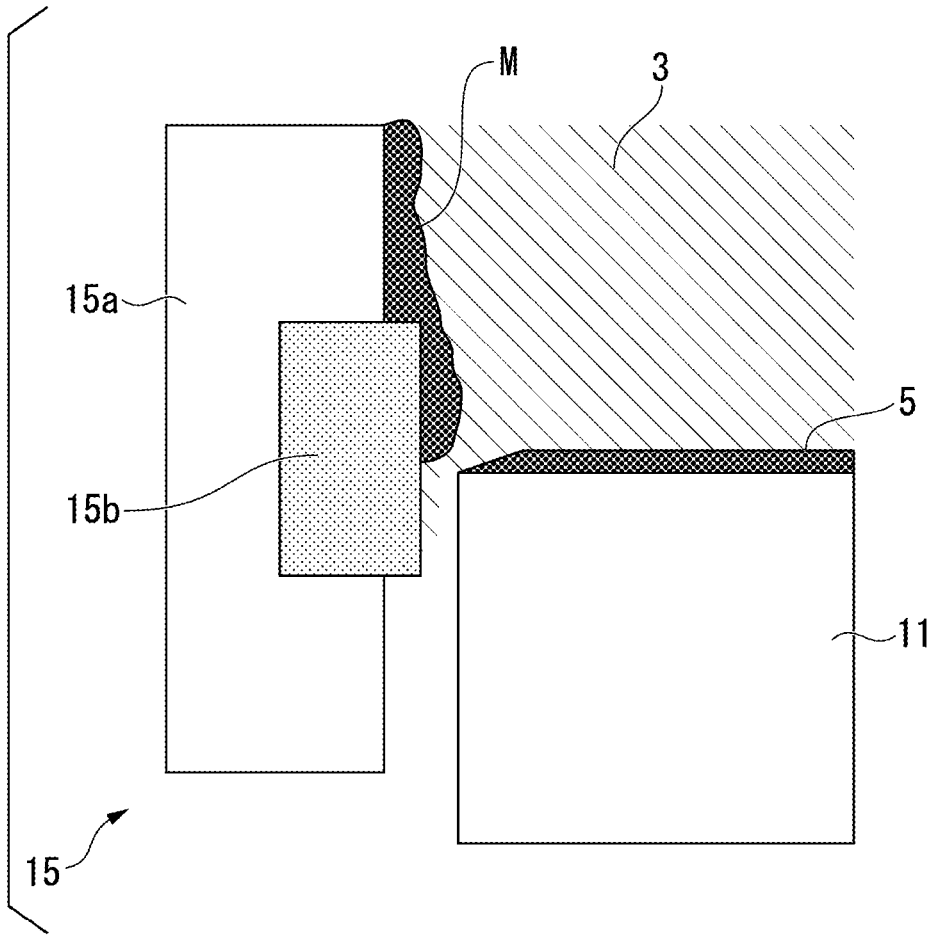
FIG. 4 is a cross-sectional explanatory view of FIG. 3.

Note that, as illustrated in FIG. 4, the side weir 15 includes a base plate 15*a* and a ceramic plate 15*b* arranged in a region where the side weir 15 is in sliding contact with the cooling drum 11, and the ceramic plate 15*b* is made of a refractory material that is harder than the base plate 15*a*. Note that FIG. 4 is a horizontal cross section of a contact portion between the end surface of the cooling drum 11 and the ceramic plate 15*b* (point E in FIG. 5(*d*)).

Here, at the start of casting in the above-described twin-drum type continuous casting apparatus 10, a dummy sheet (not illustrated) is inserted between the pair of cooling drums 11 and 11 with cooling drums 11 and 11 stopped, and the molten steel 3 is supplied to the molten steel pool portion 16.

The cooling drums 11 and 11 are then rotationally started, and the cast strip 1 is pulled out from a lower side of the cooling drums 11 and 11.

At this time, immediately after the start of casting, the molten steel 3 in the molten steel pool portion 16 is solidified, the thickness of the cast strip 1 is thicker, and a hump-shaped thickened portion, that is, a portion where the plate thickness of the cast strip 1 locally increases is formed.

Furthermore, in the molten steel pool portion 16, shell washing occurs in which a discharge flow of the molten steel 3 from the immersion nozzle 19 flushes the solidified shell 5. This shell washing does not occur when the height of the molten steel surface in the molten steel pool portion 16 is high.

Here, a relationship between the cooling drum 11 and the side weir 15 immediately after the start of casting will be described with reference to FIG. 5.

Figure 5:
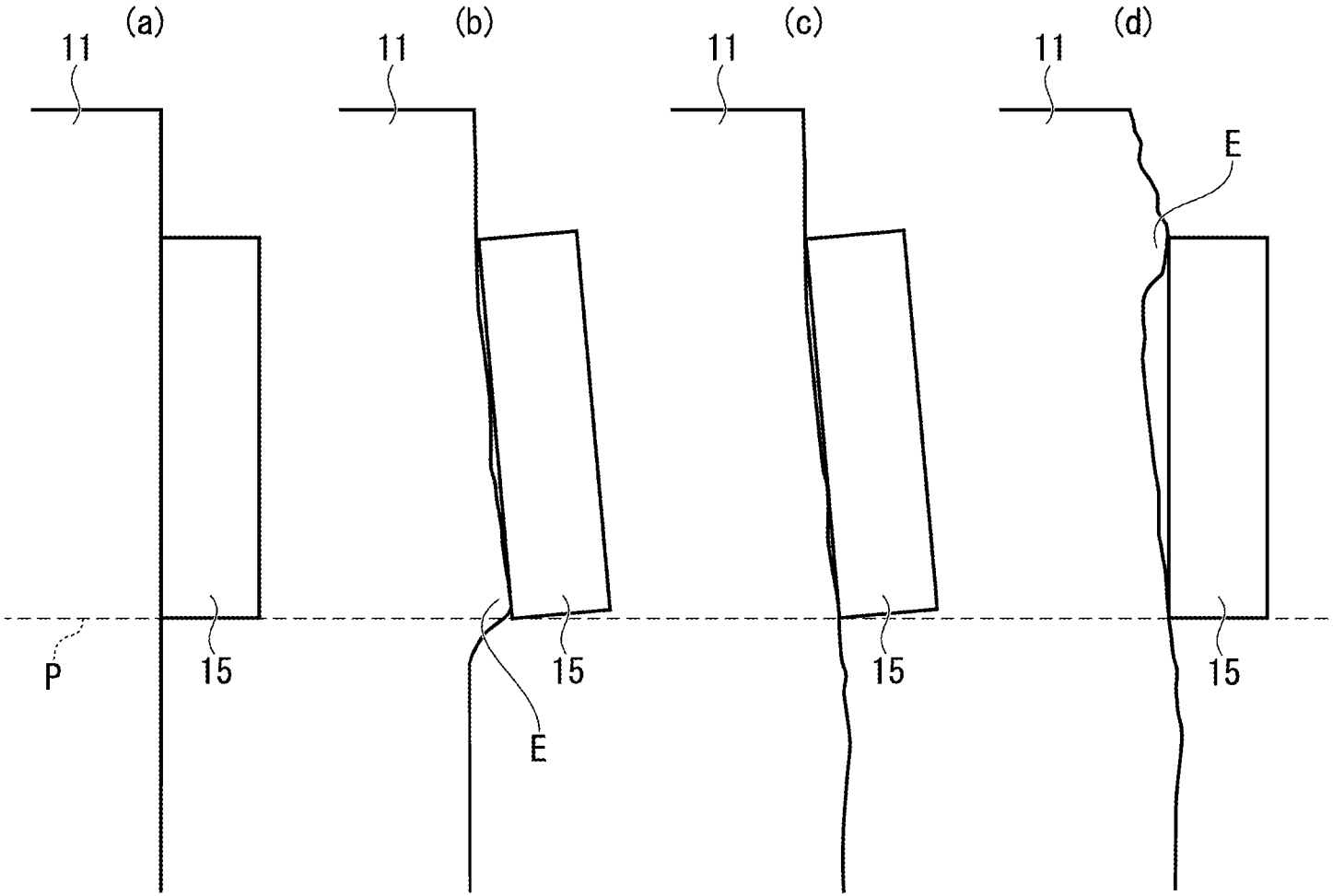
FIG. 5 is an explanatory view of a cooling drum and the side weir at a start of casting.

First, as illustrated in FIG. 5(*a*), the cooling drum 11 and the side weir 15 are in close contact with each other before the molten steel 3 is supplied.

The molten steel 3 is supplied with the cooling drums 11 and 11 stopped. As illustrated in FIG. 5 (*b*), the cooling drum 11 is thermally expanded due to the contact with the molten steel 3 in the vicinity of a closest point P (drum kiss point) of the cooling drums 11 and 11, and a thermal expansion portion E is formed. Note that a region on a front side in a drum rotation direction R with respect to the closest point P of the cooling drums 11 and 11 is not in contact with the molten steel 3, and thus is not thermally expanded, and a large step is generated between the region on the front side and the thermal expansion portion E.

On the other hand, a region on a rear side in the drum rotation direction R with respect to the closest point P of the cooling drums 11 and 11 is located on the molten steel pool portion 16, and thus is thermally expanded due to the contact with the molten steel 3, but the amount of thermal expansion gradually decreases toward the rear side in the drum rotation direction R on the basis of contact time with the molten steel 3. Therefore, no large gap is generated although the side weir 15 is in contact with the cooling drums 11 and 11 in an inclined state.

In this state, the rotation of the cooling drums 11 and 11 is started. Also at this time, as illustrated in FIG. 5(*c*), the region on the rear side in the drum rotation direction R with respect to the closest point P of the cooling drums 11 and 11 is thermally expanded, but since the amount of thermal expansion gradually decreases toward the rear side in the drum rotation direction R, no large gap is generated although the side weir 15 is in contact with the cooling drums 11 and 11 in an inclined state.

When the cooling drum 11 rotates further, and the thermal expansion portion E (a portion located at the closest point P (drum kiss point) of the cooling drums 11 and 11 when the cooling drum 11 is stopped at the start of casting) is located in a region where the thermal expansion portion E is in sliding contact with the side weir 15, a gap is generated between the side weir 15 and the cooling drum 11, as illustrated in FIG. 5(*d*). Here, when the size of the gap is, for example, 0.2 mm or more, the molten steel 3 enters this gap.

Here, at the start of casting, as illustrated in FIG. 4, the base metal M is formed on a surface of the side weir 15, and the molten steel 3 having entered the gap between the side weir 15 and the cooling drum 11 is solidified, integrated with the above-described base metal M, and caught between the cooling drums 11 and 11.

In a portion where the base metal M has been caught between the cooling drums 11 and 11, the plate thickness of the cast strip is locally thickened in the width direction and a longitudinal direction.

Therefore, in the present embodiment, pressure control of the cooling drums 11 and 11 is separately performed by (a) a first step from a state where the pair of cooling drums 11 and 11 are stopped until the pair of cooling drums 11 and 11 are rotationally started, and the thickened portion of the cast strip 1 passes through the closest point P (drum kiss point) of the pair of cooling drums 11 and 11, (b) a second step after the first step until the cooling drums 11 and 11 make one or more rotations, and (c) a third step after the second step.

Each step will be described below with reference to FIG. 6, which is an explanatory diagram illustrating a pressure control method for the cooling drums.

(First Step)

Figure 6:
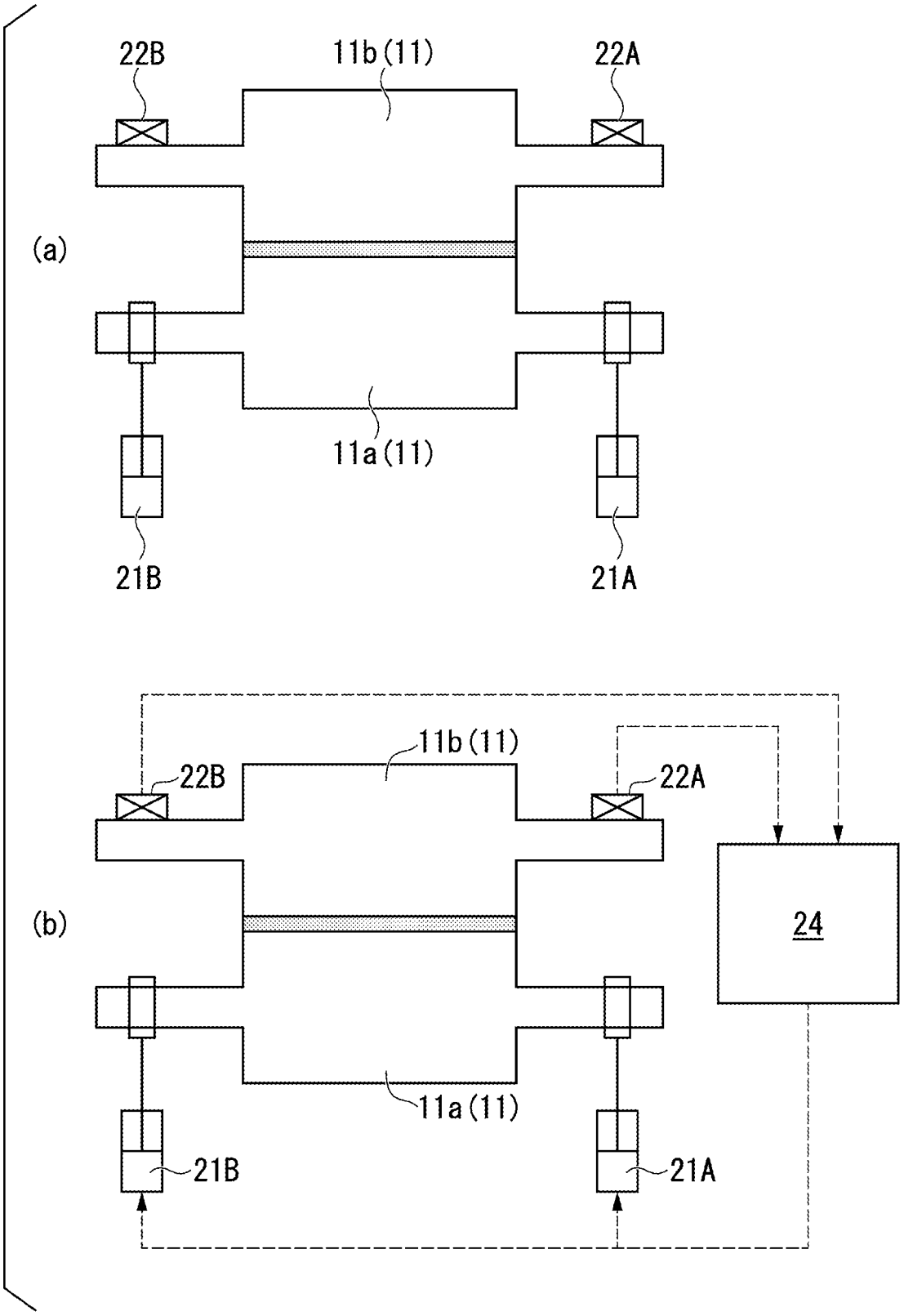
FIG. 6 is an explanatory diagram illustrating a pressure control method for cooling drums in a first step, a second step, and a third step.

First, in the first step, as illustrated in FIG. 6(*a*), hydraulic cylinders 21A and 21B arranged on one end side and another end side in a rotation axis direction of the pair of cooling drums 11 and 11 press a cooling drum 11*a* with a predetermined pressure (first pressure) in a direction in which the pair of cooling drums 11 and 11 come close to each other.

In the present embodiment, as illustrated in FIG. 6(*a*), a configuration is adopted in which the hydraulic cylinders 21A and 21B are arranged on the cooling drum 11*a* on a moving side and press the cooling drum 11*a* on the moving side toward a cooling drum 11*b* on a fixed side. Note that the hydraulic cylinders 21A and 21B are fixed to a side surface of a column, but the column is not illustrated for simplification.

The first pressure is aimed at as high a value as possible without affecting the start of the cooling drum 11, and a specific numerical value of the first pressure is mainly determined by the width, the diameter, the type of molten metal, and the maximum drum driving force of the cooling drum 11. In reality, it is difficult to obtain an appropriate value by a prior calculation or the like, and thus the appropriate value is obtained and set in an actual test.

(Second Step)

Next, in the second step, as illustrated in FIG. 6(*a*), the hydraulic cylinders 21A and 21B arranged on the one end side and the another end side in the rotation axis direction of the pair of cooling drums 11 and 11 press the cooling drum 11*a* with a predetermined pressure (second pressure) in the direction in which the pair of cooling drums 11 and 11 come close to each other.

Note that the second pressure is aimed at as high a value as possible without causing damage such as deformation to the surface of the cooling drum 11, and is mainly determined by the width, the diameter, the surface shape, the surface material, the molten metal type, and the maximum drum reduction of the cooling drum 11. In reality, as with the first pressure, an appropriate value is obtained and set in an actual test.

Here, the second pressure in the second step is set higher than the first pressure in the first step.

That is, in the first step and the second step, the hydraulic cylinders 21A and 21B arranged on the one end side and the another end side in the rotation axis direction of the pair of cooling drums 11 and 11 press the cooling drum 11*a* with the same pressure in the direction in which the pair of cooling drums 11 and 11 come close to each other. Therefore, as described above, even if the base metal M is caught, the portion where the base metal M has been caught is pressed in the direction in which the cooling drums 11 and 11 come close to each other.

Note that, in the present application, the "same pressure" allows an error of 10%, but in order to start the casting more stably, it is preferable to control the error range so as to allow an error of 5% or less, more preferably 1% or less.

(Third Step)

Next, in the third step, as illustrated in FIG. 6(*b*), the pressure control is performed so that a total value of reaction forces on the one end side and the another end side in the rotation axis direction of the pair of cooling drums 11, 11 is set to a predetermined value, and rotation axes of the pair of cooling drums 11 and 11 are held in parallel.

Specifically, as illustrated in FIG. 6(*b*), the hydraulic cylinders 21A and 21B are arranged on the cooling drum 11*a* on the moving side, and load cells 22A and 22B are arranged on the cooling drum 11*b* on the fixed side. Note that the load cells 22A and 22B are fixed to a side surface of a column, but the column is not illustrated for simplification. Reaction force signals measured by the load cells 22A and 22B are transmitted to a reaction force control unit 24, and the reaction force control unit 24 gives a command for the hydraulic cylinders 21A and 21B to move forward and backward so that a sum load is the predetermined value.

As a result, the rotation axes of the pair of cooling drums 11 and 11 are held in parallel, and the cast strip 1 whose plate thickness is controlled is manufactured. Note that the predetermined value of the sum load is mainly intended to maintain the stability of operation within the range satisfying the quality of the cast strip 1 and is mainly determined by the width, the diameter, and the type of molten metal of the cooling drum 11. In reality, as with the first pressure and the second pressure, an appropriate value is obtained and set in an actual test.

Here, the second step is preferably a period after the first step until the cooling drum 11 makes two or more rotations.

However, if a switching timing from the second step to the third step is delayed, an initial defective amount until the cast strip 1 having a controlled plate thickness is obtained increases, and thus it is preferable to switch to the third step before the cooling drum 11 makes three rotations.

According to the manufacturing method for the cast strip 1 according to the present embodiment configured as described above, in the second step after the first step until the cooling drums 11 and 11 make one or more rotations, the hydraulic cylinders 21A and 21B arranged on the one end side and the another end side in the rotation axis direction of the pair of cooling drums 11 and 11 press the cooling drum 11*a* with a predetermined pressure (second pressure) in the direction in which the pair of cooling drums 11 and 11 come close to each other. Thus, the thermal expansion portion E of the cooling drum 11 is located in the region where the thermal expansion portion E is in sliding contact with the side weir 15, and a gap is generated between the side weir 15 and the cooling drum 11. Therefore, even if the molten steel 3 enters this gap and the base metal M is caught, the portion where the base metal M has been caught is pressed in the direction in which the cooling drums 11 and 11 come close to each other, and the solidified shells 5 and 5 can be sufficiently reduced at the closest point P (drum kiss point) of the pair of cooling drums 11 and 11. Therefore, the unsolidified portion in the central portion of the thickness of the cast strip 1 is hardly formed, and the strength of the cast strip is maintained. As a result, breakage of the cast strip 1 can be suppressed, and the casting can be started stably.

Furthermore, in the manufacturing method for the cast strip 1 according to the present embodiment, in a first step from a state where the pair of cooling drums 11 and 11 are stopped until the pair of cooling drums 11 and 11 are rotationally started, and the thickened portion of the cast strip 1 passes through the closest point P (drum kiss point) of the pair of cooling drums 11 and 11, the hydraulic cylinders 21A and 21B arranged on the one end side and the another end side in the rotation axis direction of the pair of cooling drums 11 and 11 press the cooling drum 11*a* with the relatively low first pressure in the direction in which the pair of cooling drums 11 and 11 come close to each other. Thus, the thickened portion of the cast strip 1 formed at the start of casting can be passed between the cooling drums 11 and 11 in a relatively stable manner, and the influence on the casting can be suppressed.

Furthermore, in the second step, since the cooling drum 11 is pressed with the second pressure higher than the first pressure in the first step, the solidified shells 5 and 5 can be sufficiently reduced at the closest point P (drum kiss point) of the pair of cooling drums 11 and 11. Therefore, the unsolidified portion in the central portion of the thickness of the cast strip 1 is hardly formed, and the strength of the cast strip can be maintained.

Note that, in the present embodiment, when the second step is the period after the first step until the cooling drum 11 makes two or more rotations, the solidified shells 5 and 5 can be sufficiently reduced at the closest point P (drum kiss point) of the pair of cooling drums 11 and 11 even if the above-described thermal expansion portion E remains until the second rotation and the base metal M is caught. As a result, the breakage of the cast strip 1 can be suppressed, and the casting can be started stably.

Although the cast strip manufacturing method according to the embodiment of the present disclosure has been specifically described above, the present disclosure is not limited to this, and can be appropriately changed without departing from the technical idea of the disclosure.

In the present embodiment, the twin-drum type continuous casting apparatus illustrated in FIG. 1 has been described as an example, but the present embodiment is not limited to this.

Furthermore, a pressing method for the cooling drums is not limited to the method illustrated in FIG. 6, and any configuration may be used as long as the pressure control can be performed as shown in the embodiment.

EXAMPLES

Results of experiments conducted to confirm effects of the present disclosure will be described below.

A cast strip made of carbon steel having a carbon content of 0.05 mass % was manufactured by use of the twin-drum type continuous casting apparatus illustrated in FIG. 1.

Here, the diameter of the cooling drum was set to 600 mm, and the width of the cooling drum was set to 400 mm. In addition, the thickness of the cast strip in steady casting was set to 2.0 mm.

In Example 1 of the present disclosure, switching from the first step to the second step was performed when the number of rotations of the cooling drum was 0.1 rotations, and switching from the second step to the third step was performed when the number of rotations of the cooling drum was 1.3 rotations.

In Example 2 of the present disclosure, the switching from the first step to the second step was performed when the number of rotations of the cooling drum was 0.1 rotations, and the switching from the second step to the third step was performed when the number of rotations of the cooling drum was 2.3 rotations.

In Comparative Example, the switching from the first step to the second step was performed when the number of rotations of the cooling drum was 0.1 rotations, and the switching from the second step to the third step was performed when the number of rotations of the cooling drum was 0.4 rotations. Note that the switching from the second step to the third step in this case corresponds to a point of time when the shell washing was completed.

In Examples 1 and 2 of the present disclosure and Comparative Example, the number of times of breakage and the number of breakages of the cast strip at the first and second rotations of the cooling drum were evaluated. The evaluation results are shown in Table 1.

Figure 7:
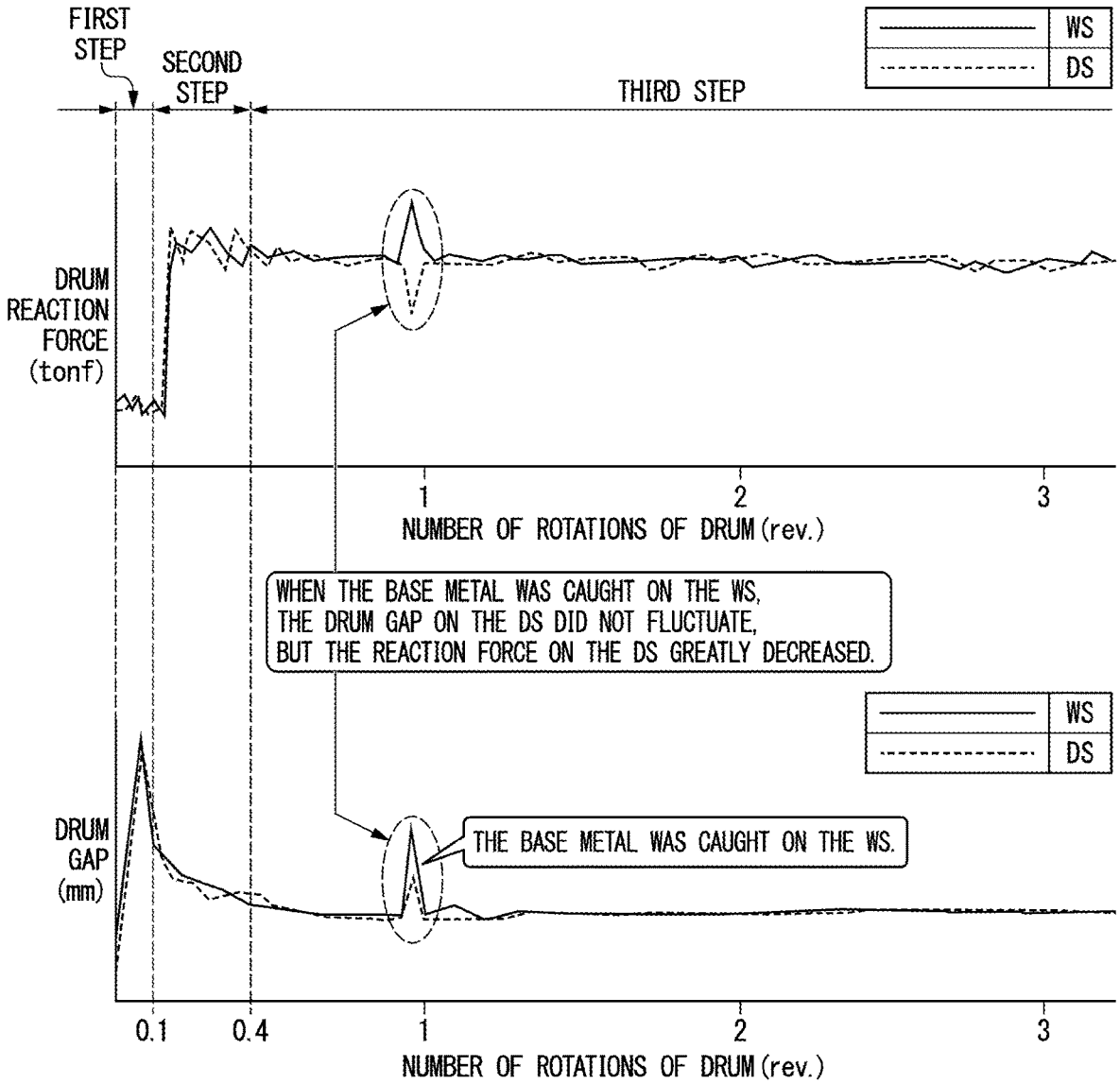
FIG. 7 is a graph illustrating a relationship between a drum reaction force and a drum gap in Comparative Example.
Figure 8:
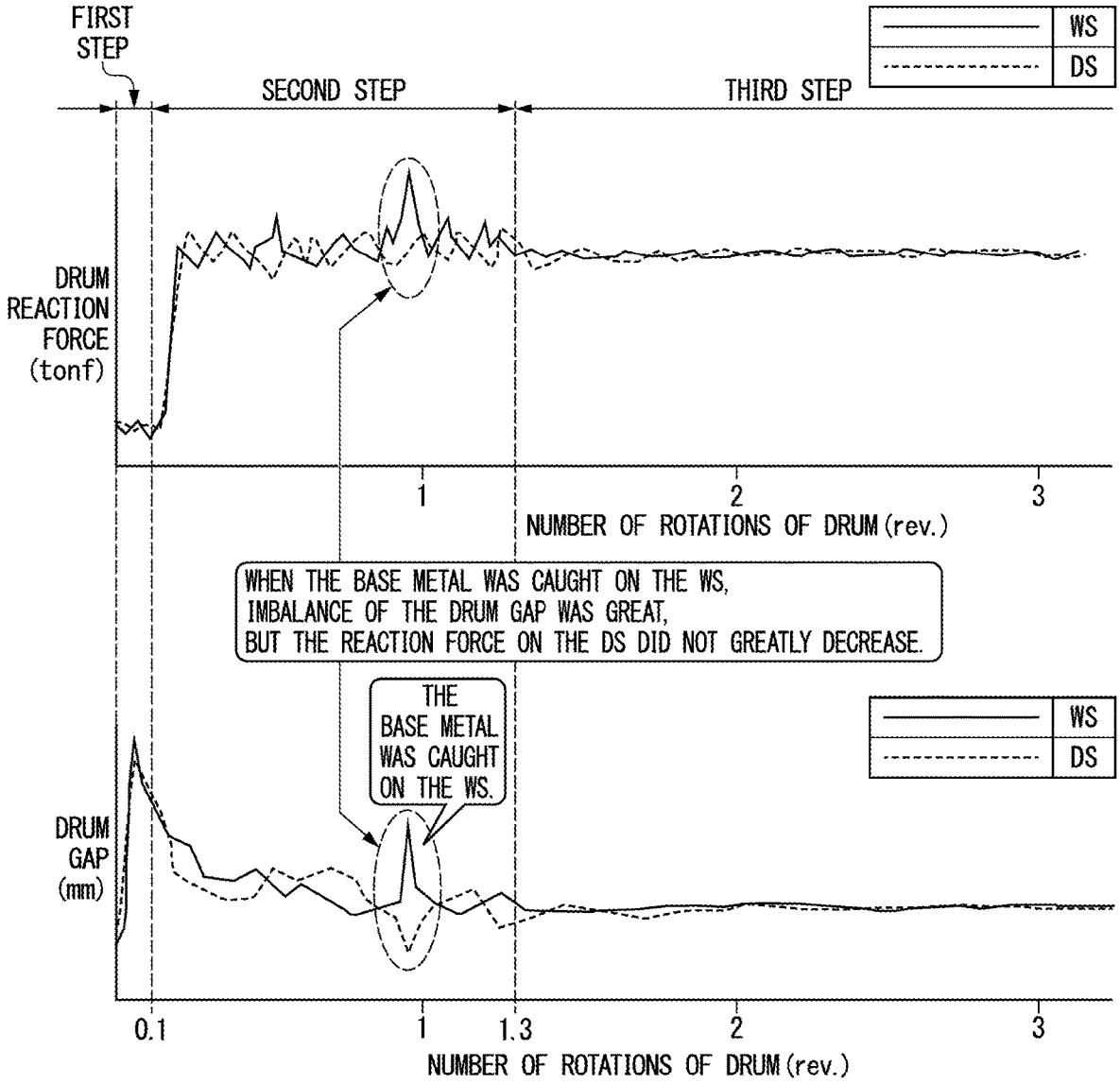
FIG. 8 is a graph illustrating a relationship between a drum reaction force and a drum gap in Example 1 of the present disclosure.

Furthermore, FIG. 7 illustrates changes in a drum reaction force and a drum gap in Comparative Example, and FIG. 8 illustrates changes in a drum reaction force and a drum gap in Example 1 of the present disclosure.

TABLE 1

| | Number of rotations of drum in switching from second step to third step | Number of tests conducted | Number of breakages of cast strip at first rotation of drum | Breakage rate (%) | Note |
|---|---|---|---|---|---|
| Example 1 | 1.3 | 12 | 0 | 0 | In two charges of 12 charges, in which the cast strip was not broken, there was a defect (small breakage) in part of the cast strip at the second rotation, but the defect was included in part that was to be originally scrapped as an unsteady portion, and thus there was no actual ham. |
| Example 2 | 2.3 | 9 | 0 | 0 | In all charges, in which the cast strip was not broken, the cast strip was in good condition over the entire length. |
| Comparative Example | 0.4 | 16 | 4 | 25 | In four charges, in which the cast strip was broken, the casting was interrupted. Furthermore, even in four charges of 12 charges, in which the cast strip was not broken, there was a defect (small breakage) in part of the cast strip. |

In Comparative Example, a breakage rate of the cast strip at the first and second rotations of the cooling drum was 25%, and the start of casting tended to be unstable.

On the other hand, in Examples 1 and 2 of the present disclosure, the breakage rate of the cast strip at the first and second rotations of the cooling drum was 0%.

Furthermore, in Comparative Example, as illustrated in FIG. 7, when the base metal was caught on a work side (WS), the drum gap on a drive side (DS) followed the WS. At this time, the drum reaction force greatly decreased on the DS, the contact of the cooling drum with the solidified shell was unstable, and the cooling was insufficient.

On the other hand, in Example 1 of the present disclosure, as illustrated in FIG. 8, the drum reaction force did not decrease on the DS even when the base metal was caught on the WS, and the solidified shells were strongly pressure-bonded to each other, and the drum gap on the DS was smaller. Therefore, there was almost no unsolidified portion in the central portion of the thickness of the cast strip, the surface temperature of the cast strip was relatively low, and the strength of the cast strip was maintained. As a result, the breakage of the cast strip was suppressed.

From the above results, according to the cast strip manufacturing method according to the present disclosure, it is confirmed that it is possible to provide a cast strip manufacturing method capable of suppressing breakage of a cast strip and starting casting stably in a twin-drum type continuous casting apparatus.

FIELD OF INDUSTRIAL APPLICATION

According to the present disclosure, it is possible to provide a cast strip manufacturing method capable of suppressing breakage of a cast strip and starting casting stably in a twin-drum type continuous casting apparatus.

BRIEF DESCRIPTION OF THE REFERENCE SYMBOLS

1 Cast strip
3 Molten steel (molten metal)
5 Solidified shell
10 Twin-drum type continuous casting apparatus
11 Cooling drum
15 Side weir
16 Molten steel pool portion (molten metal reservoir)

What is claimed is:

1. A cast strip manufacturing method that supplies molten metal to a molten metal reservoir formed by a pair of cooling drums that rotate and a pair of side weirs, and forms and grows solidified shells on peripheral surfaces of the pair of cooling drums to manufacture a cast strip, the cast strip manufacturing method comprising:

pressing one end side and another end side in a rotation axis direction of the pair of cooling drums with a first pressure, which presses the one end side and the another end side with the same pressure, in a direction in which the pair of cooling drums come close to each other, in a first step until a thickened portion of the cast strip passes through a closest point of the pair of cooling drums after starting rotation of the cooling drums, the thickened portion being formed when the molten metal is supplied to the molten metal reservoir with the pair of cooling drums stopped at a start of casting;

pressing the one end side and the another end side in the rotation axis direction of the pair of cooling drums with a second pressure, which presses the one end side and the another end side with the same pressure and is higher than the first pressure, in the direction in which the pair of cooling drums come close to each other, in a second step from after the first step until the pair of cooling drums make one or more rotations; and performing pressure control so that a total value of reaction forces on the one end side and the another end side in the rotation axis direction of the pair of cooling drums is set to a predetermined value, and rotation axes of the pair of cooling drums are held in parallel, in a third step after the second step.

2. The cast strip manufacturing method according to claim 1, wherein the second step is a period from after the first step until the pair of cooling drums make two or more rotations.

* * * * *